United States Patent [19]

Buchner et al.

[11] 4,281,963

[45] Aug. 4, 1981

[54] APPARATUS FOR THE CONVEYANCE AND/OR TREATMENT OF HOT GASES

[75] Inventors: Heinrich Buchner, Bochum-Weitmar; Hannes S. Horn, Dortmund, both of Fed. Rep. of Germany

[73] Assignee: Klöckner-Humboldt-Deutz AG, Fed. Rep. of Germany

[21] Appl. No.: 7,805

[22] Filed: Jan. 30, 1979

[30] Foreign Application Priority Data

Aug. 18, 1978 [DE] Fed. Rep. of Germany ..... 2836163

[51] Int. Cl.[3] ..... F01D 5/08; F01D 5/18

[52] U.S. Cl. ..... 415/178; 165/92; 415/180

[58] Field of Search ..... 415/178, 180, 80; 165/92; 432/66; 366/147

[56] References Cited

U.S. PATENT DOCUMENTS

| | | | |
|---|---|---|---|
| 664,776 | 12/1900 | Porter | 165/92 X |
| 1,689,189 | 10/1928 | Broadhurst | 165/92 |
| 1,828,799 | 10/1931 | Carlson | 165/92 |
| 2,611,241 | 9/1952 | Schulz | 415/178 X |
| 2,680,007 | 6/1954 | Arbuckle | 415/180 X |
| 3,285,330 | 11/1966 | Root | 366/147 X |

FOREIGN PATENT DOCUMENTS

| | | | |
|---|---|---|---|
| 473878 | 3/1929 | Fed. Rep. of Germany | 165/92 |
| 1250984 | 10/1971 | United Kingdom | 366/147 |

*Primary Examiner*—Philip R. Coe

*Attorney, Agent, or Firm*—Hill, Van Santen, Steadman, Chiara & Simpson

[57] ABSTRACT

An apparatus is disclosed for the conveyance and/or treatment of material-laden hot gases in a furnace for the calcination and sintering of lime, magnesite, dolomite or the like. The apparatus is utilized as a ventilator or ventilator mill in the furnace and is cooled by means of a cooling liquid circulating in a closed cooling circuit. Channels are provided in the ventilating apparatus for the liquid coolant and particularly such channels are provided in portions of the apparatus such as blades which are subject to the greatest heat stresses.

14 Claims, 3 Drawing Figures

APPARATUS FOR THE CONVEYANCE AND/OR TREATMENT OF HOT GASES

BACKGROUND OF THE INVENTION

The invention relates to an apparatus such as a blower for the conveyance and/or treatment of hot gases, particularly of dust or material laden hot gases, in a ventilator or ventilator mill portion of furnaces or other devices for the calcination and sintering of lime, magnesite, dolomite or the like.

In the case of thermal processes, particularly upon the calcination of sintering of lime, dolomite, or magnesite, it is frequently necessary for the attainment of high efficiency to draw off the hot gases at determined points of the furnace or other devices for the thermal treatment, and to convey it back again at other points. For this efficiency, thermally high loadable or chargeable conveyor apparatus are necessary, which may also overcome the flow resistance of the hot gases through the materials to be treated.

It is known for the conveyance of hot gases laden with materials inclined to caking to utilize injectors. The injectors have the disadvantage that their degree of efficiency is poor, that is, below 50% and that the pressure increase attainable with them is relatively low.

Beyond this, injectors have the further disadvantage that their function is dependent upon the differences in density between the driving medium and the conveyed medium. The pressure relations in the furnace must therefore be adapted either to the injectors or the compression must take place gradually at some expense.

SUMMARY OF THE INVENTION

It is an object of the invention to provide an apparatus for the conveyance and/or treatment of hot gases, particularly of dust or material laden hot gases, whose temperature lies between 600° and 1300°., wherein the apparatus overcomes the above mentioned disadvantages, and wherein the apparatus operates continuously at higher pressure conditions. It is to be attained in this connection that the conveyor apparatus remains free from deposits of the conveyed material or the dusts.

This object is solved in that the apparatus is constructed as a mechanical apparatus and is cooled at least partially by means of a cooling liquid, particularly a heat-carrying oil, which circulates in a closed cooling circuit. Through this construction, it is advantageously possible to attain at a desired point directly in the hot gas stream an optimally controllable gas conveyance or material treatment. In contrast to the known injectors, a pressure increase of more than 300 mm. water column may be produced. It was found completely surprisingly that even material-conducting hot gases up to 1300° C. may be conveyed through the apparatus according to the invention without the conveying or treatment devices resulting in cakings, deposits, or intolerable temperatures, i.e. temperatures of a normal material, for example, steel, being exceeded. Thus, the expensive supervision devices and installations for the injectors may be eliminated. In accordance with the invention, a better degree of efficiency of the conveyance or treatment is attained and an improved design of the calcination process is possible with low investment costs.

In a development of the invention, the heat carrying oil is a silicon oil. Through utilization of a silicon oil, the reliability of the cooling is advantageously increased, since even at a relatively high temperature difference in a structural part of the apparatus, the formation of vapor or steam blisters may be prevented. In addition, through the utilization of the high operating temperature of the silicon oil, a large quantity of heat may be transported off from a relatively small quantity of liquid, so that the delivery lines and cooling chambers may be held advantageously small.

As an operating temperature for the silicon oils, a temperature of up to 270° C. is possible. The lay-out of the cooling means is such that 220° C. is not exceeded.

In further development of the apparatus the cooled surface parts of the apparatus are provided with double walls, and that in the interior of the cooled, surface parts, at least partial guide walls or baffles are constructed. Through the double-walled construction, just as through a hollow construction of the shaft and hub, it is insured that all parts of the apparatus may be cooled uniformly since therefore all parts of the apparatus have liquid flow therethrough. For the distribution of the cooling liquid, guide plates serve in this connection, if necessary, which are constructed as guide-walls or baffles, so that an eddy formation in the corners of the surface parts may be prevented. Furthermore, actually the entire surface of the apparatus may be held at so low a temperature that there is no problem of build-up of adhesive layers.

In a further development of the invention, it is provided that in the parts of the apparatus having heat carrying oil flowing therethrough, especially at points subjected on several sides to the hot medium, heat transfer ribs are arranged which extend in a direction of flow of the cooling liquid. Through this construction, it is possible to attain an increased heat removal at points, as for example the tips of blades which are acted on at several sides by heat. For the prevention of eddies, in this connection the cooling ribs are arranged in the direction of flow. This also has an advantageous conducting effect as a result. In connection with the guide-walls according to the invention, there results through the heat transfer ribs the possibility of a uniform heat removal adapted to the heat load. Thus, the maximal operating temperature of the cooling medium may reliably be prevented from being exceeded at points charged with heat.

In a further development of the invention, it is provided that the individual parts of the apparatus, particularly the cooled parts, are constructed flexibly with one another. Therefore the parts, which on account of their shape are hindered for expansion in one direction, for example, discs, do not hinder the expansion of other parts, for example, the blades or vanes. Expansion and contraction strains, however, occur in the especially crack-sensitive contact points of the individual parts.

In a further development of the invention the rotating part of the apparatus is constructed asymmetrically in the axial direction, and the rotating parts of the apparatus are connected with one another solely in the plane of symmetry. Through this construction the expansions occurring do not lead to a distortion of the rotating part of the apparatus. Through the connection of the rotating parts in the plane of symmetry in the case of the symmetrical construction, a reliable unhindered expansion of the rotating parts is made possible which prevents flaws in these especially stressed parts.

In a further development of the invention, it is provided that the cooled parts of the apparatus are constructed to be curved only in one direction. Therefore it is advantageously attained that in the curved parts, unavoidable expansion and shrinkage tensions are held as small as possible. Both in a direction of the curvature as well as also in a transverse direction, the individual parts, for example, the spiral housing outer wall, may freely expand and shrink back again. Tensions occur solely in that the inner wall and the outer wall are unequally long. The tensions extend, however, according to the invention, solely in a direction of the curvature and are negligibly small.

In a further development of the invention, the connecting armatures for the delivery conduits of the cooling liquid and the bearings for the rotating parts are arranged outside of the hot gas stream. Therefore the particularly heat-sensitive parts of the apparatus do not need to withstand high temperatures. In order to not permit the length of the rotor shaft to become too large, in this connection as a rule the bearing is arranged within the brick lining of the hot gas channels and cooled separately, for example, by means of air.

In a further embodiment of the invention, for the cooling liquid a heat exchanger is present which is constructed as a heat exchanger with the fuel and/or the combustion air. By means of the heat exchanger, the heat transported by the cooling liquid may be rapidly dissipated and, by construction as a heat exchanger, guided back again to the calcination process. By means of cooling of the apparatus, the total degree of thermal efficiency of the calcination or treatment process is not negatively influenced.

In a further development of the invention, the cooling liquid conduits have pressure monitors, thermostats and flowmeters. With these auxiliary devices, an automatic supervision and if need be emergency shut-off may take place if disturbances or leaks should set in on the apparatus or the delivery conduits. Therefore, it is made possible to inject a heat carrying oil, accordingly a combustible liquid, for the cooling.

In a further development of the invention the individual parts or partial groups, as for example, shaft, hub, spiral housing, side walls, etc. are flowed through in parallel-guided branches by the cooling liquid. Therefore it is advantageously possible to adapt the cooling of the individual parts to their thermal load. Thus, the cooling of the individual parts may be determined such that the apparatus has overall equal surface temperatures and that neither the critical adhesion temperature for the substances carried along by the gas is exceeded, nor are the individual parts cooled down unnecessarily. Therefore the expansion condition of the apparatus is positively influenced.

In a further development of the invention the material of the apparatus is at least partially steel, particularly austenitic steel in a sheet metal construction. Through the utilization of steel, particularly of austenitic steel in sheet metal construction, it is possible to produce the apparatus in a simple welded construction with double walls according to the invention. The utilization of austenitic steel increases the reliability against FeO-formation, especially on surface sections which are thermally highly stressed.

In a further embodiment of the invention, the non-rotating parts of the apparatus consist of a material of a mineral base, especially fireproof stones or fireproof stamped ground or clay. By means of the construction of the non-rotating parts of the apparatus of fireproof masonry or the like, it is advantageously possible to simplify the apparatus appreciably if no mechanical stresses occur at the non-rotating part in a blower to facilitate its installation. It is sufficient for operation if the gas channel in the area of the apparatus is shaped geometrically in accordance with the requirements, for example, in the form of inflow channels with attached spiral housing. A cooling of the masonry is not necessary. In this embodiment, it is the stationary gas conducting part of the apparatus constructed at least in two parts. Through this technique, the installation and, if need be, the construction of the rotating part is substantially facilitated, and a regular easy inspection of the rotating part is made possible.

BRIEF DESCRIPTION OF THE DRAWINGS

FIG. 2 illustrates a section through the hub of the radial compressor according to FIG. 1, as well as.

DESCRIPTION OF THE PREFERRED EMBODIMENTS

Figure 1:
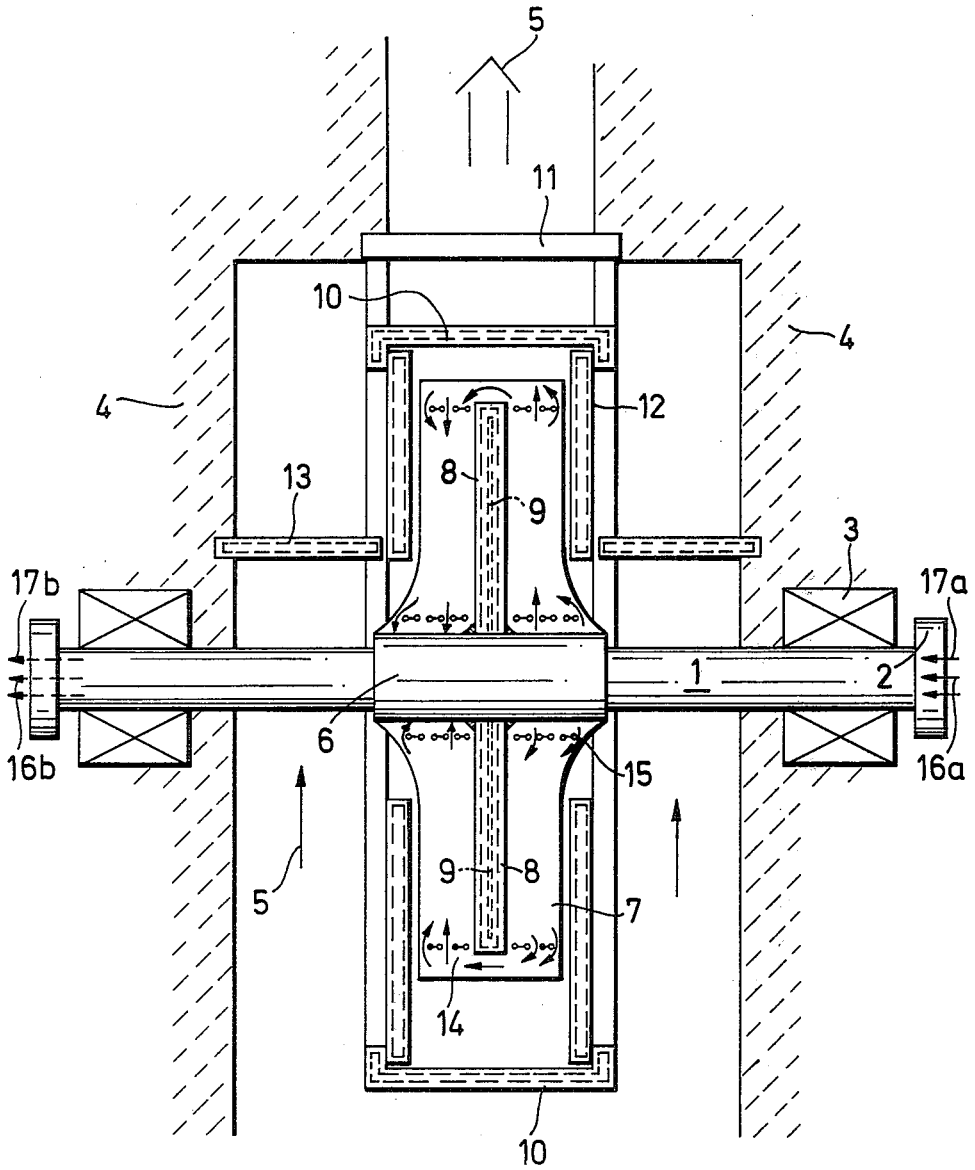
FIG. 1 illustrates a section through a gas conveying apparatus constructed as a radial compressor.

In FIG. 1, the reference character 1 indicates the shaft of the gas conveying apparatus with the drive and cooling liquid introduction flanges 2. The shaft 1 runs in the bearings 3, which are arranged in the wall 4 of the hot air channel. The hot air channel consists advantageously as shown of stone material, but may, however, also consist of steel resistant to high heat. The arrows 5 indicate the path of the hot gases.

In the interior of the conveyor apparatus are located the blades 7 which are held and guided by the middle disc 8, which carries in its interior a cooling liquid conducting wall 9. The blades 7 are advantageously constructed so that they may be flowed through lengthwise by the cooling liquid. For this purpose the blades lying in each case adjacent one another are connected on their outer side by a transverse channel 14 through which the cooling liquid in the blade may flow over on the other side of the central disc 8. The blades 7 have in their interior flow distribution members 15, which insure that the cooling liquid is actually distributed over the entire cross-sectional surface of the blades 7. Therefore it is advantageously attained that there is a flow-through of the otherwise stream-free corners. The blades 7 may be constructed both straight as well as also curved forwards or backwards. The blades 7 are guided and held by means of grooves or the like on the hub 6 and the middle disc 8, so that they may freely expand from their fastening point inwardly on the blade foot with respect to the hub 6 and the middle disc 8.

The delivery and takeoff conduit of the cooling liquid to the conveying apparatus is indicated by the arrows 16 and 17 where the index a indicates the inlet and the index b the outlet of the cooling liquid. The cooling liquid 16 serves especially for the cooling of the blades 7, while the cooling liquid 17 advantageously cools the shaft 1, the hub 6 and the middle disc 8. The delivery of the cooling liquid to the stationary spiral housing parts 10 and 12 takes place advantageously on the tongue lying to the rear of the plane of the drawing, at the beginning of the spiral housing, while the outlet of the cooling liquid takes place in the area of the flange 11. The spiral housing 10 consists advantageously of three main parts, namely, the outer sleeve 10 and the side parts 12, which in each case are flowed through separately by the cooling liquid. The parts of the spiral housing are arranged so that the side parts 12 and the sleeve 10 may expand individually in an unhindered manner.

For the conduction of the hot gases, there is arranged in the hot gas channel around about the shaft 1 the guide housing 13 which advantageously likewise has a separate cooling liquid inflow and outflow.

Through the distribution of the cooling liquid according to the invention in parallel, with the cooling streams flowing through the conveying apparatus it is possible to cool the individual parts of the apparatus separately so that it corresponds with their heat absorption. In connection with the separate expansion of the individual parts of the apparatus, flaws, bulges etc. may reliably be prevented.

Figure 2:
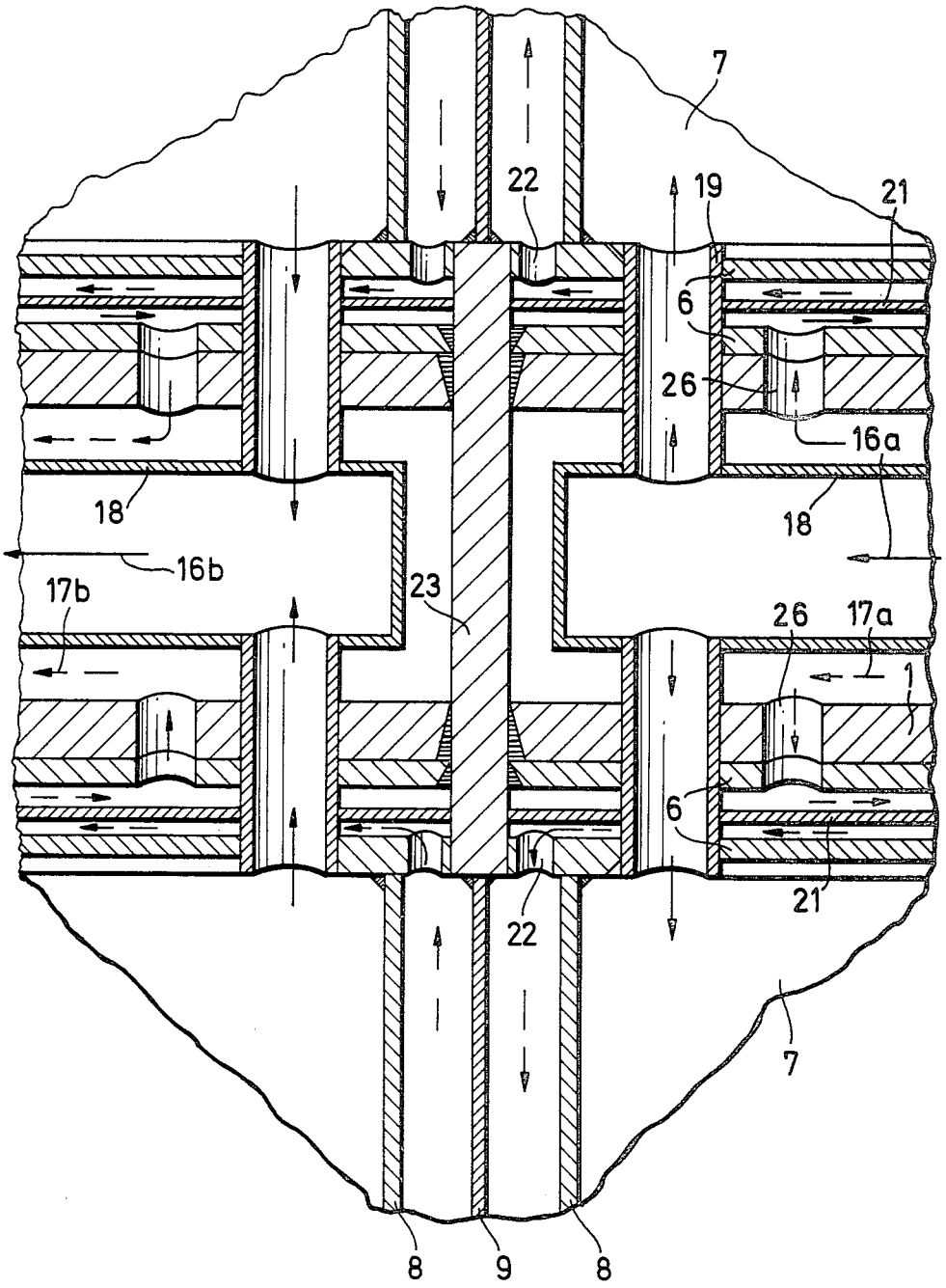

The cooling liquid guidance symmetry is shown in FIG. 2. In the shaft 1 is arranged the delivery pipe 18 for the cooling liquid 16*a* of the blades 7, which conducts the cooling liquid through the branch pipes 19 directly into the vanes 7. Therefore it advantageously results that the vanes 7 will be supplied in a well controlled manner at the highest stressed parts of the apparatus with a sufficiently large quantity of liquid. The shaft 1 will be cooled by means of the cooling liquid 17*a* which flows on through the bores 26 in the interior of the hub 6. An advantageous longitudinal flow-through of the hub 6 is thereby attained by means of the cylindrical baffle plate 21. From the hub 6 the cooling liquid 17*a* flows through the bores 22 also in the middle disc 8, where it is likewise guided by the baffle plate 9 so that the middle disc 8 is flowed through in radial manner. From the middle disc 8, the cooling liquid then again reaches the hub 6 and then returns back again from there into the shaft 1.

The rotating part of the apparatus is constructed fully symmetically, and the middle of the connecting disc 23 is between the two shaft halves at the point of symmetry. From here, the shaft 1, the hub 6, the vanes 7 and the middle disc 8 freely expand.

Figure 3:
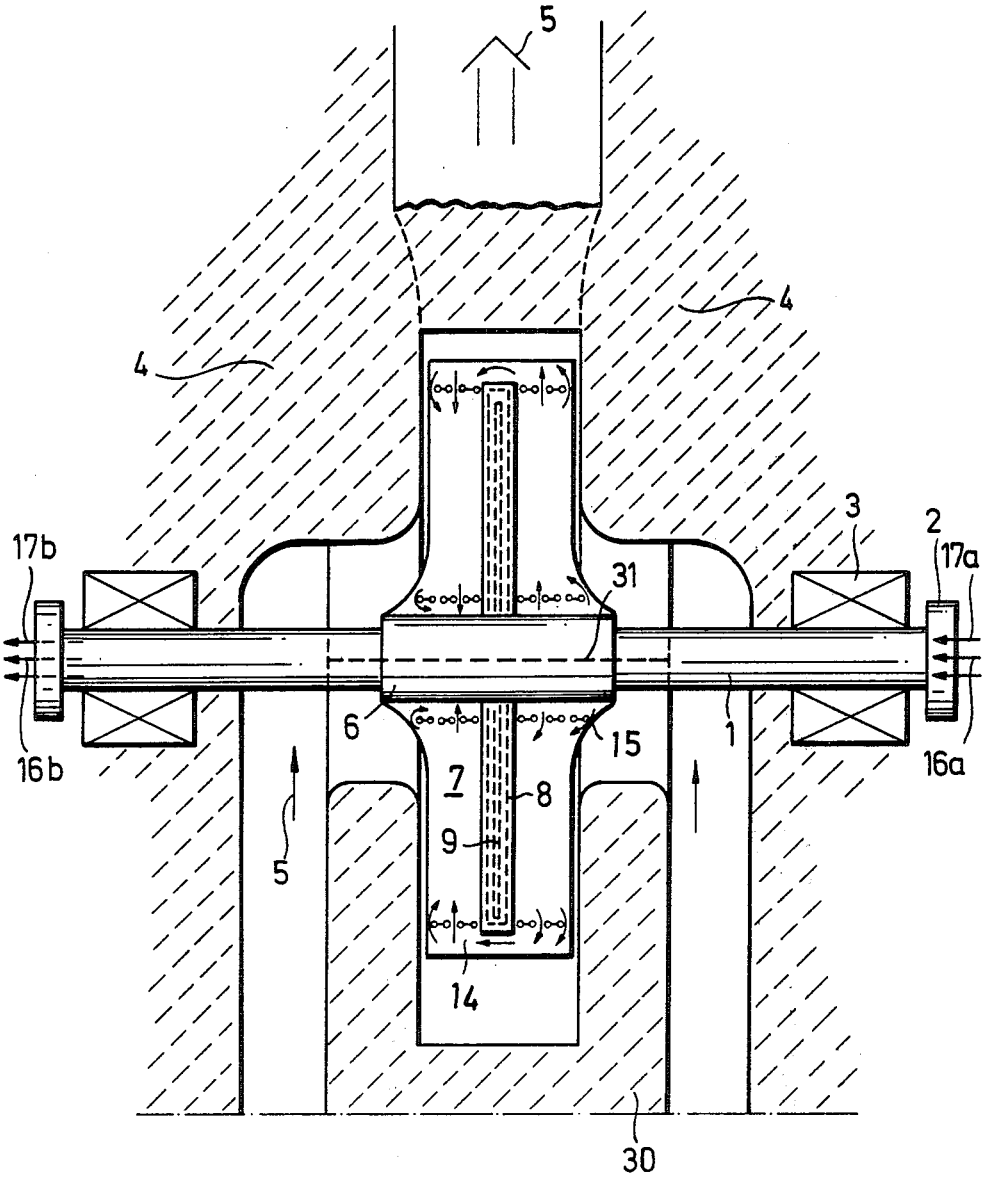
FIG. 3 illustrates an embodiment with a hot gas channel constructed as a gas conducting part.

In FIG. 3 is shown an embodiment in which the gas conducting part is a part of the masonry 4. The part 30 of the masonry 4, which forms the spiral housing, is in this connection divided into the partial joint 31 in order to provide an easy mounting and, if need be, demounting of the rotating part of the apparatus. In this embodiment, the spiral housing may be both round as well as a polygon but with a certain degree of loss of efficiency.

The part that is stressed the most, the tongue at the beginning of the spiral housing, is thereby advantageously constructed as a cast shaped brick. The other parts of the spiral housing form may be bricked or provided in stamped ground or clay.

In the embodiment shown in FIG. 3 is a construction of the apparatus according to the invention which has a wheel with straight vanes for very high gas temperatures and gases with greater dust load. Advantageously a sound-damping effect is present which is adjusted through the masonry jacket on the wheel.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A shaft furnace or kiln ventilator system for cooling material laden hot gases produced during calcination and sintering of one of the materials selected from the group consisting of lime, dolomite, and magnesite, comprising: a liquid cooled ventilator positioned in the furnace or kiln to convey the hot gases and having a rotating shaft and radial blades extending from a hub on said shaft, and a disc on said hub extending perpendicular to the shaft, perpendicular to a major surface of the blades, and bisecting the blades along a line of connection therewith; a guide housing at least partially surrounding the radial blades; and a means for introducing a heat carrying liquid into the ventilator through the rotating shaft and means for guiding the liquid through the radial blades.

2. The system of claim 1 wherein the cooling liquid comprises a heat carrying oil, and the hot gases have a temperature exceeding 600° C.

3. The system of claim 1 wherein the radial blades are hollow and a channel is formed beyond the radial disc so as to connect bisected portions of the blades to one another, a path for the cooling liquid being formed from the hub into the blades on one side of the disc, through the channel, and back to the hub on the opposite side of the disc.

4. The system of claim 2 wherein first and second independent paths are provided for first and second cooling liquids, respectively, the first path running through the rotating shaft, into and out of the blades, and out an opposite end of the shaft, and the second path running into the rotating shaft, into the hub, into and then out of the radial disc, then back to the shaft via the hubs and out the other end of the rotating shaft.

5. The system of claim 1 wherein the disc is hollow and has a separating wall therein forming a cooling liquid path out from the hub along one side wall to a periphery of the disc and then back along an opposite side wall to the hub.

6. The system of claim 1 wherein the radial blades are hollow, and wherein small baffle plates are provided near corners of the blades which prevent eddy currents and which improve cooling liquid flow at corner spaces of the blades.

7. The system of claim 1 wherein the hot gases attain a temperature of 1300° C.

8. The system of claim 1 wherein the housing has hollow walls for providing a cooling liquid.

9. The system of claim 1 wherein the cooling liquid comprises a silicon oil.

10. The system of claim 1 wherein the disc and radial blades are connected to one another so as to permit relative expansion with respect to one another during conveyance of the hot gases.

11. The system of claim 1 wherein the ventilator blades and disc are constructed of austenite steel.

12. A shaft furnace or kiln ventilating system for cooling material laden hot gases produced during calcination and sintering of one of the materials selected from the group consisting of lime, dolomite, and magnesite, comprising: a liquid cooled ventilator positioned in the furnace or kiln to convey the hot gases and having a rotating shaft and hollow radial blades having oppositely positioned cooling surfaces extending from said shaft; connecting chambers extending transverse to and from the cooling surfaces of all the blades and extending between adjacent blades; a first cooling liquid path being formed through said rotating shaft to said hollow blades; and a second independent cooling liquid path not in liquid communication with the first path being formed through said rotating shaft and into said connecting chambers.

13. The system according to claim 1 wherein the housing is comprised of a material of a mineral base.

14. The system according to claim 1 wherein the housing is comprised of fireproof stamped clay.

* * * * *